US006338699B1

(12) United States Patent
Veitch

(10) Patent No.: US 6,338,699 B1
(45) Date of Patent: Jan. 15, 2002

(54) CHILD SPORT ACTIVITY TRAINING DEVICE

(76) Inventor: Timothy Dale Veitch, 923 Mayland Drive N.E., Calgary, Alberta (CA), T2E 6C3

( * ) Notice: Subject to any disclaimer, the term of this patent is extended or adjusted under 35 U.S.C. 154(b) by 0 days.

(21) Appl. No.: 09/576,047

(22) Filed: May 23, 2000

(51) Int. Cl.[7] ..... A63B 1/00; A62B 35/00
(52) U.S. Cl. ..... 482/69; 119/770
(58) Field of Search ..... 482/69, 148, 140, 482/141, 124; 119/770, 857, 907; 2/311; 182/3

(56) References Cited

U.S. PATENT DOCUMENTS 4,410,175 A 10/1983 Shamp
4,922,860 A 5/1990 Hutchings
4,981,110 A 1/1991 Llewellyn
5,120,287 A 6/1992 Brown et al.
5,122,107 A * 6/1992 Gardner ..... 482/140
5,388,551 A * 2/1995 Martusciello ..... 119/770
5,476,070 A * 12/1995 Gwon et al. ..... 119/770
5,498,219 A 3/1996 Soufi
5,766,114 A * 6/1998 Campbell ..... 482/55
5,820,533 A * 10/1998 Goldman ..... 482/124
5,848,956 A 12/1998 Grettner
6,125,792 A * 10/2000 Gee ..... 119/770

* cited by examiner

*Primary Examiner*—Stephen R. Crow
(74) *Attorney, Agent, or Firm*—I. Zborovsky

(57) ABSTRACT

A child sport activity training device comprising a harness for enclosing and supporting a torso of a child therein. A hand grip is grasped by a hand of a trainer. An adjustment structure is between a rear portion of the harness and the hand grip to compensate for weight and balance between the trainer and the child when the hand grip is positioned above the harness.

6 Claims, 2 Drawing Sheets

CHILD SPORT ACTIVITY TRAINING DEVICE

BACKGROUND OF THE INVENTION

1. Field of the Invention

The present invention relates generally to training devices. More particularly, the invention comprises a child sport activity training device.

In general, a first field of use of the disclosed invention is by manufacturers of infant walking aids as the most likely benefactors of the unique advantages of the instant invention. However, many other fields, such as manufacturers of disabled persons training harnesses and makers of sports equipment, could find potentially beneficial uses of this invention.

Thus, it can be seen that the potential fields of use for this invention are myriad and the particular preferred embodiments described herein is in no way meant to limit the use of the invention to the particular field chosen for exposition of the details of the invention.

A comprehensive listing of all the possible fields to which this invention may be applied is limited only by the imagination and is, therefore, not provided herein. Some of the more obvious applications are mentioned in the interest of providing a full and complete disclosure of the unique properties of this previously unknown general purpose article of manufacture. It is to be understood from the outset that the scope of this invention is not limited to these fields or to the specific examples of potential uses presented herein.

2. Description of the Prior Art

Attempts have been made in the prior art to devise training devices for infants and disabled persons. Training devices are shown in U.S. Pat. No. 4,410,175, issued to Ellis W. Shamp on Oct. 18, 1983, 4,922,860, issued to Deborah A. Hutchings on May 8, 1990, 4,981,110, issued to Giannia Llewellyn on Jan. 1, 1991, 5,120,287, issued to Linda E. Brown et al. on Jun. 9, 1992, 5,498,219, issued to Abdoull E. Soufi on Mar. 12, 1996 and 5,848,956, issued to Norman L. Grettner on Dec. 15, 1998.

U.S. Pat. No. 4,410,175 To Shamp discloses a safety suspension unit and harness for developing jumps in figure skating. The safety suspension unit consists of a tracking carriage connectable to an elevated fixed track. A spring loaded pulley system with a support cable is connected to a harness for guiding a skater, in the learning and practicing of jumps and spins.

U.S. Pat. No. 4,922,860 to Hutchings discloses a child or disabled person training harness. The harness includes an adjustable generally orthogonal strap means adapted to fit around and conform to the body of a wearer. An integral handle means is adapted to be held by a person or machine using the harness to support the wearer.

U.S. Pat. No. 4,981,110 to Llewellyn discloses a baby walker organization. It comprises a one-piece harness to overlie a child's torso with a front panel and back panel interconnected by a bottom web with leg apertures positioned on either side of the bottom web. Shoulder straps are integrally formed to the front and back panels defining arm openings aligned relative to one another through side portions. It may be utilized in a first orientation to assist the child in learning to walk and repositionable for use as a backpack.

U.S. Pat. No. 5,120,287 to Brown et al. discloses an infant walking aid. It includes a harness mechanism for enclosing and supporting the infant therein. A first bar member is secured to an upper section of the harness mechanism to be grasped by an operator. A second bar member flexibly secured to the harness mechanism is adapted to be grasped by the infant for providing support.

U.S. Pat. No. 5,498,219 to Soufi discloses an infant walking trainer. The infant walking trainer includes a handle and a body harness suspended from the handle. The harness supports the infant in an upright walking stance when the handle is held overhead the infant.

U.S. Pat. No. 5,848,956 to Grettner discloses a multipurpose lat sling. It is constructed so that it may be used by an exerciser, to perform a variety of exercises, to develop the latissimus dorsi, triceps and abdominal muscles of the human body.

The present invention is completely different than these patents in that it consists of a child sport activity training device. A torso harness with a VELCRO secured waist belt and crossover back straps is placed upon the child. A hand grip with an adjustment feature is connected to a rear portion of the crossover back straps to compensate for weight and balance between a trainer and the child.

None of the above inventions and patents, taken either singly or in combination, is seen to describe the instant invention as claimed.

SUMMARY OF THE INVENTION

The present invention is a child sport activity training device that consists of a torso harness with a VELCRO secured waist belt, crossover back straps and a hand grip with an adjustment feature to compensate for weight and balance between a trainer and the child.

Accordingly, it is a principal object of the invention to provide a child sport activity training device that will overcome the shortcomings of the prior art devices.

Another object of the invention is to provide a child sport activity training device that would allow a trainer to safely take the weight off the child, when necessary, without imposing stress to the child's shoulders or the trainer's spine.

An additional object of the invention is to provide a child sport activity training device that though initially developed for ice skating, would also have applications in teaching cycling, skiing, swimming, skateboarding, roller blading and surfing.

A further object of the invention is to provide a child sport activity training device that is simple and easy to use.

A still further object of the invention is to provide a child sport activity training device that is economical to manufacture.

It is an object of the invention to provide an improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
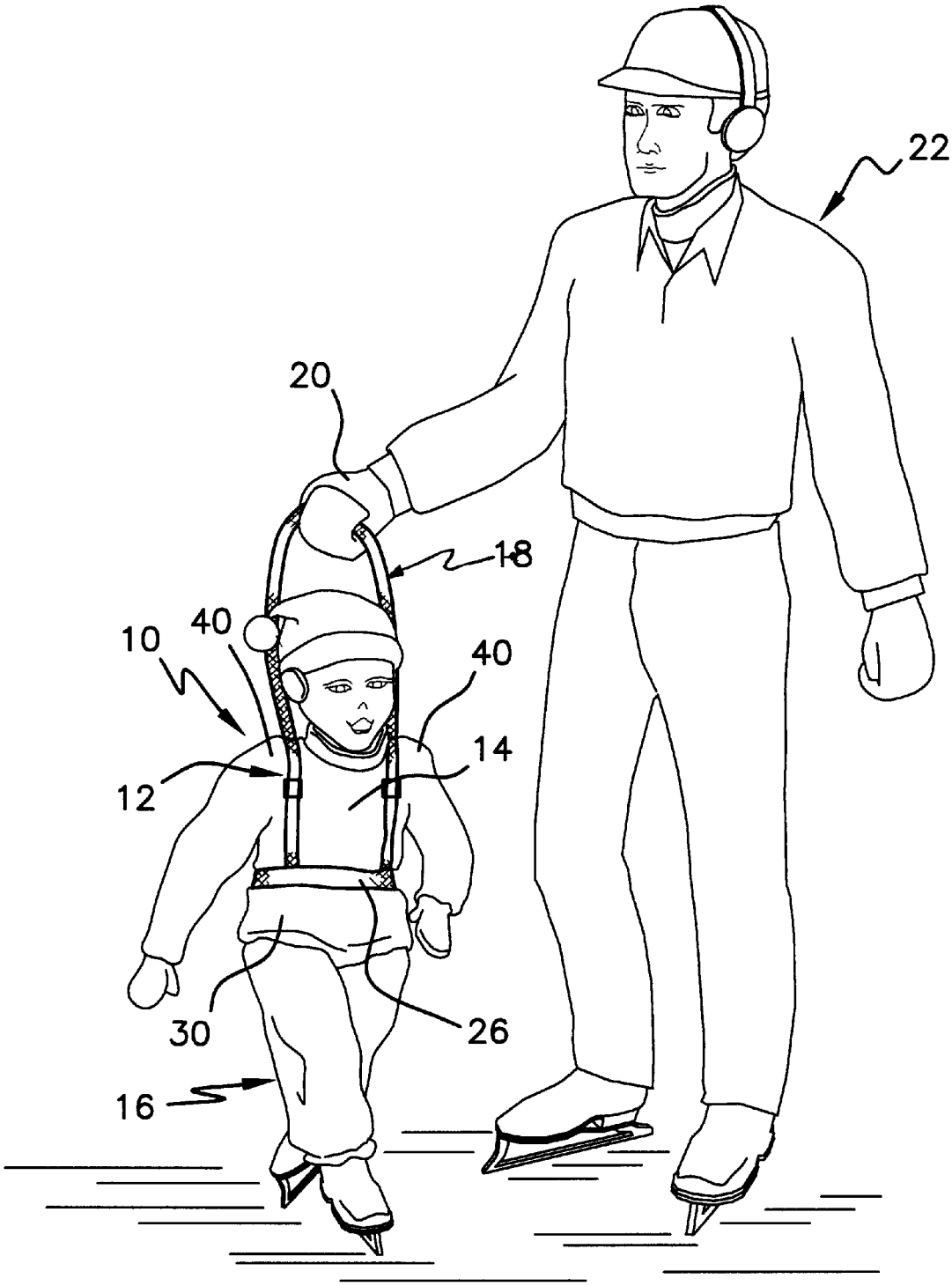
FIG. 1 is a front perspective view of the present invention placed upon a child, showing a trainer grasping the hand grip thereof.
Figure 2:
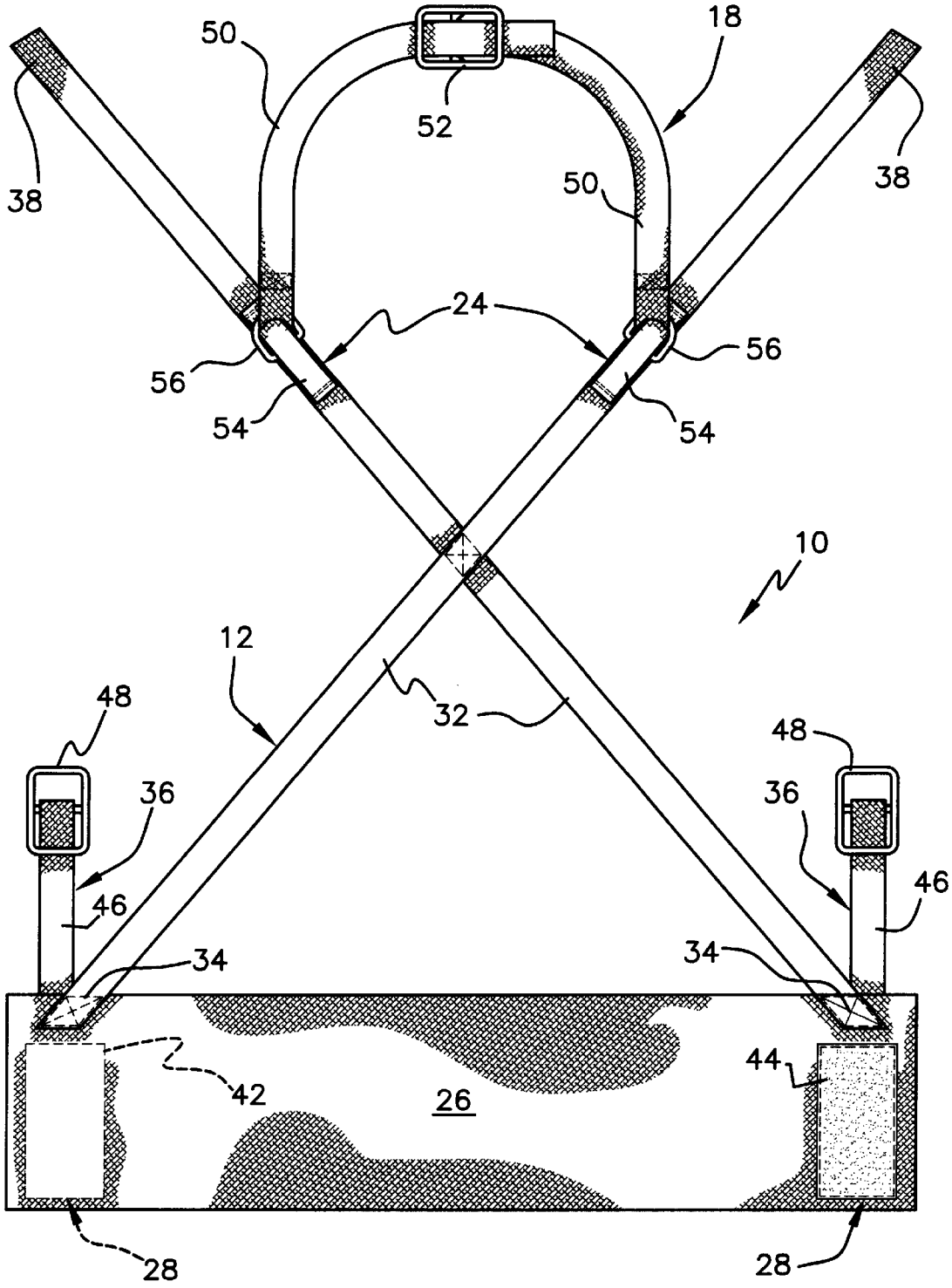
FIG. 2 is a rear view of the present invention per se in an opened position.

Turning now descriptively to the drawings, in which similar reference characters denote similar elements throughout the several views, FIGS. 1 and 2 illustrate the various components of the present invention being a child sport activity training device 10 comprising a harness 12 for enclosing and supporting a torso 14 of a child 16 therein. A hand grip 18 is grasped by a hand 20 of a trainer 22. An adjustment structure 24, as best seen in FIG. 2, is between a rear portion of harness 12 and hand grip 18 to compensate for weight and balance between trainer 22 and child 16 when hand grip 18 is positioned above harness 12.

Harness 12 consists of a waist belt 26. Assembly 28 is for securing in an adjustable manner waist belt 26 about a waist 30 of child 16. A pair of crossover back straps 32 are provided. Each back strap 32 is attached at a rearward end 34 to waist belt 26. Assembly 36 is for securing in an adjustable manner a forward end 38 of each back strap 32, extending over the shoulders 40 of child 16 to waist belt 26.

First securing assembly 28 includes a pair of VELCRO fasteners 42, 44. Each VELCRO fastener 42, 44 is connected to an opposite end of waist belt 26. Second securing assembly 36 consists of a pair of web members 46. Each web member 46 is connected vertically at a lower end to one end of waist belt 26. A pair of clasps 48 are provided. Each clasp 48 is affixed to an upper end of one web member 46 for engagement with a forward end 38 of one back strap 32.

Hand grip 18 includes a pair of straps 50. A buckle 52 is for retaining free ends of straps 50 together. Adjustment structure 24 consists of a pair of flexible strips 54. Each flexible strip 54 is attached at opposite ends to one back strap 32. A pair of D-rings 56 are provided. Each D-ring 56 slides between one flexible strip 54 and one back strap 32 and is affixed to a lower end of one strap 50 of hand grip 18.

To use child sport activity training device 10, as best seen in FIG. 1, waist belt 26 is placed about waist 30 of child 16, so that VELCRO fasteners 42, 44 can be pressed together. Back straps 32 are then extended over shoulders 40 of child 16 to engage with clasps 48. Hand 20 of trainer 22 can grasp hand grip 18 above child 16.

Adjustment structure 24 will compensate for weight and balance between trainer 22 and child 16. Trainer 22 can safely take weight off child 16, when necessary, without imposing stress to shoulders 40 of child 16 or spine of trainer 22. Child 16 can train for ice skating, as shown, or develop skills in cycling, skiing, swimming, skateboarding, roller blading and surfing.

It is to be understood that the present invention is not limited to the embodiments described above, but encompasses any and all embodiments within the scope of the following claims.

I claim:

1. A child sport activity training device comprising:

a harness means for enclosing and supporting a torso of a child therein;

a hand grip means to be grasped by a hand of a trainer; and an adjustment means between a rear portion of said harness means and said hand grip means to compensate for weight and balance between said trainer and said child when said hand grip means is positioned above said harness means, wherein said harness means includes:

a waist belt;

first means for securing in an adjustable manner said waist belt about a waist of said child;

a pair of crossover back straps, wherein each said back strap is attached at a rearward end to said waist belt; and second means for securing in an adjustable manner a forward end of each said back strap, extending over the shoulders of said child, to said waist belt, and wherein said second securing means includes:

a pair of web members, in which each said web member is connected vertically at a lower end to one end of said waist belt; and a pair of clasps, in which each said clasp is affixed to an upper end of one said web member for engagement with a forward end of one said back strap.

2. The child support activity training device as recited in claim 1, wherein said first securing means includes a pair of VELCRO fasteners, in which each said VELCRO fastener is connected to an opposite end of said waist belt.

3. The child sport activity training device is recited in claim 1, wherein said hand grip means includes:

a pair of straps; and a buckle for retaining free ends of said straps together.

4. A child sport activity training device comprising:

a harness means for enclosing and supporting a torso of a child therein;

a hand grip means to be grasped by a hand of a trainer; and an adjustment means between a rear portion of said harness means and said hand grip means to compensate for weight and balance between said trainer and said child when said hand grip means is positioned above said harness means, wherein said harness means includes:

a waist belt;

first means for securing in an adjustable manner said waist belt about a waist of said child;

a pair of crossover back straps, wherein each said back strap is attached at a rearward end to said waist belt; and second means for securing in an adjustable manner a forward end of each said back strap, extending over the shoulders of said child, to said waist belt, a pair of straps; and a buckle for retaining free ends of said straps together, wherein said adjustment means includes:

a pair of flexible strips, wherein each said flexible strip is attached at opposite ends to one said back strap; and a pair of D-rings, wherein each said D-ring slides between one said flexible strip and one said back strap and is affixed to a lower end of one of said strap of said hand grip means.

5. The child support activity training device as recited in claim 4 wherein said first securing means includes a pair of VELCRO fasteners, in which each said VELCRO fastener is connected to an opposite end of said waist belt.

6. The child support activity training device as recited in claim 4 wherein said second securing means includes:

a pair of web members, in which each said web member is connected vertically at a lower end to one end of said waist belt; and a pair of clasps, in which each said clasp is affixed to an upper end of one said web member for engagement with a forward end of one said back strap.

* * * * *